US005944590A

United States Patent [19]

Isobe et al.

[11] Patent Number: 5,944,590

[45] Date of Patent: Aug. 31, 1999

[54] POLISHING APPARATUS HAVING RETAINER RING ROUNDED ALONG OUTER PERIPHERY OF LOWER SURFACE AND METHOD OF REGULATING RETAINER RING TO APPROPRIATE CONFIGURATION

[75] Inventors: Akira Isobe; Tomotake Morita, both of Tokyo, Japan

[73] Assignee: NEC Corporation, Tokyo, Japan

[21] Appl. No.: 08/746,215

[22] Filed: Nov. 7, 1996

[30] Foreign Application Priority Data

Nov. 14, 1995 [JP] Japan ..... 7-295617

[51] Int. Cl.[6] ..... B24B 5/00

[52] U.S. Cl. ..... 451/288; 451/285; 451/398

[58] Field of Search ..... 451/285, 287, 451/288, 289, 41, 397, 398

[56] References Cited

U.S. PATENT DOCUMENTS

| | | | |
|---|---|---|---|
| 5,084,071 | 1/1992 | Nenadic et al. . | |
| 5,573,448 | 11/1996 | Nakazima | 451/41 |
| 5,584,751 | 12/1996 | Kobayashi et al. | 451/41 |
| 5,643,053 | 7/1997 | Shendon | 451/288 |
| 5,645,474 | 7/1997 | Kubo et al. | 451/288 |
| 5,651,724 | 7/1997 | Kimura et al. | 451/285 |
| 5,664,989 | 9/1997 | Nakata et al. | 451/285 |
| 5,679,065 | 10/1997 | Henderson | 451/288 |
| 5,749,771 | 5/1998 | Isobe | 451/41 |

FOREIGN PATENT DOCUMENTS

| | | |
|---|---|---|
| 0 517 594 | 12/1992 | European Pat. Off. . |
| 0 589 433 | 3/1994 | European Pat. Off. . |
| 3-33053 | 2/1991 | Japan . |
| 4-51358 | 4/1992 | Japan . |
| 2 292 254 | 2/1996 | United Kingdom . |

OTHER PUBLICATIONS

"The Effect of the Pad Dressing on the Interlayer Dielectric Film CMP", *The Proceedings of 42 Spring Meeting of Japan Applied Physics*, p. 788, No. 30p–C–16.

*Primary Examiner*—Eileen P. Morgan
*Attorney, Agent, or Firm*—Young & Thompson

[57] ABSTRACT

A polishing apparatus has a retainer for retaining a semiconductor wafer on a polishing pad, and the outer periphery of the retainer ring is rounded so as to minimize a deformation produced in the polishing pad, thereby improving the surface profile of the semiconductor wafer.

16 Claims, 8 Drawing Sheets

POLISHING APPARATUS HAVING RETAINER RING ROUNDED ALONG OUTER PERIPHERY OF LOWER SURFACE AND METHOD OF REGULATING RETAINER RING TO APPROPRIATE CONFIGURATION

FIELD OF THE INVENTION

This invention relates to a polishing apparatus for creating a flat surface on a semiconductor wafer and, more particularly, to a polishing apparatus having retainer ring rounded along the outer periphery of the lower surface and a method of regulating the retainer ring to an appropriate configuration.

DESCRIPTION OF THE RELATED ART

A lithography process requires a high degree of global planarity on a semiconductor wafer, and a semiconductor device manufacturer repeats a polishing in the manufacturing process for a semiconductor integrated circuit device. For example, a lower conductive pattern for word lines is covered with an inter-level insulating layer, and the rise and fall due to the conductive pattern is transferred to the upper surface of the inter-level insulating layer. In order to form contact holes in the inter-level insulating layer, a photo-resist layer is spread over the inter-level insulating layer, and the rise and fall of the inter-level insulating layer affects the global planarity of the upper layer of the photo-resist layer. A pattern image for the contact holes is optically transferred from a photo-mask to the upper surface of the photo-resist layer so as to form a latent image. However, if the global planarity of the upper layer is poor, the pattern image is locally defocused on the upper surface of the photo-resist layer, and does not exactly form the latent image in the photo-resist layer.

If the inter-level insulating layer is polished before the optical pattern transfer, the pattern image is exactly focused on the entire upper surface of the photo-resist layer, and, accordingly, forms the latent image exactly corresponding thereto. The minimum pattern geometry is getting severer and severer, and the optical pattern transfer requires a higher degree global planarity. Thus, the polishing is indispensable step of a process of fabricating an ultra large scale integration.

An inter-level insulating layer is polished by using a chemical mechanical polishing apparatus, and the polishing pad is usually different between the polishing for the inter-level insulating layer and the polishing for creating a smooth surface on a semiconductor wafer. When a semiconductor wafer is polished, the semiconductor wafer is pressed against a polishing pad formed from non-woven fabric. On the other hand, it is desirable for an inter-level insulating layer to use a polishing pad formed of material harder than the non-woven fabric such as urethane foam. The polishing pad is usually formed from a soft cushion layer and a hard polishing layer. The hard polishing layer is laminated on the soft cushion layer, and the soft cushion layer is expected to make the hard polishing layer uniformly held in contact with a surface to be polished.

FIG. 1 illustrates a typical example of the polishing apparatus. The prior art polishing apparatus comprises a rotatable polishing table 1, and a polishing pad 2 attached to the upper surface of the rotatable polishing table 1. The polishing pad 2 is formed of a soft cushion layer and a hard polishing layer. Though not shown in FIG. 1, the rotatable polishing table 1 is accompanied with a suitable driving mechanism, and is driven for rotation around a center axis thereof.

The prior art polishing apparatus further comprises a wafer holder 3, a conditioner 4 and a slurry feeder 5. The wafer holder 3 is swingable, rotatable and movable in an up-and-down direction. The wafer holder 3 presses a semiconductor wafer against the polishing pad 2, and gives rise to a relative motion between the semiconductor wafer and the polishing pad 2.

The conditioner 4 is also swingable, rotatable and movable in the up-and-down direction. The conditioner 4 presses a diamond-coated pellet 4*a* against the polishing pad 2, and gives rise to a relative motion between the diamond-coated pellet 4*a* and the polishing pad 2 so as to keep the polishing pad 2 clear.

The slurry feeder 5 is provided over the polishing pad 2, and mixture 5*a* of polishing slurry and water is dripped from the slurry feeder 5 onto the polishing pad 2 during the polishing. The polishing slurry participates both chemical and mechanical steps in the polishing.

Turning to FIG. 2, the wafer holder 3 includes a hub 3*a* and a retainer ring 3*b* detachable from the hub 3*a*. A resilient pad layer 3*c*, which is called as "insert pad", is provided between the lower surface of the hub 3*a* and a semiconductor wafer WF1 , and the retainer ring 3*b* prevents the semiconductor wafer WF1 from a side slip on the polishing pad 2. The retainer ring 3*b* is formed of hard synthetic resin, and has a side surface 3*d* at right angles with respect to a lower surface 3*e*. The semiconductor wafer WF1 has a rounded outer periphery PR1, and projects from the lower surface 3*e* of the retainer ring 3*b* by about 200 microns.

Using the prior art polishing apparatus, a flat surface is created on an inter-level insulating layer as follows. FIG. 3A illustrates a semiconductor structure fabricated on a semiconductor wafer WF2. A field oxide layer 6*a* is selectively grown on the major surface of the semiconductor wafer WF2, and lower metal wirings 6*b*/6*c* are formed on the field oxide layer 6*a*. The lower metal wirings 6*b*/6*c* are 0.8 micron thick. An inter-level insulating layer 6*d* of silicon oxide is deposited to 2 microns thick over the field oxide layer 6*a* and the lower wirings 6*b*/6*c* by using a plasma-assisted chemical vapor deposition. The lower metal wirings 6*b*/6*c* and the exposed surface of the field oxide layer 6*a* forms a rise and fall surface, and the rise and fall is transferred to an upper surface 6*e* of the inter-level insulating layer 6*d*.

The semiconductor wafer WF2 is held by the wafer holder 3, and is pressed against the polishing pad 2 at 500 g/cm$^2$. The polishing pad 2 is, by way of example, a lamination of IC1000 and SUBA400 manufactured by Rodel Corporation, and SC112 manufactured by Cabot Corporation is supplied from the slurry feeder 5 to the polishing pad at 100 cc/minute. The polishing table 1 is rotated at 20 rpm, and the wafer holder 3 rotates the semiconductor wafer WF2 at 20 rpm on the polishing pad 2. Then, the inter-level insulating layer 6*d* of silicon oxide is polished at 1300 angstroms per minute. Though not shown in FIGS. 3A and 3B, a pattern of 3 mm×3 mm is formed over the semiconductor wafer WF2, and is also covered with the inter-level insulating layer 6*d*. A step takes place in the inter-level insulating layer 6*d*, and is referred to as "global step". The polishing is continued for 5 minutes, and a flat upper surface 6*e* is created on the inter-level insulating layer 6*d* as shown in FIG. 3B. The global step is decreased to 1000 angstroms.

However, a polishing rate is not constant over the polished surface of the semiconductor wafer WF2. This phenomenon is derived from the two-layer polishing pad 2. When the wafer holder 3 presses a semiconductor wafer WF3 against the polishing pad 2 as shown in FIG. 4, the contact pressure is maximized in the outer peripheral area of the semiconductor wafer WF3, and the polishing pad 2 is deformed in an inner area 2*a* inside of the outer peripheral area due to the reaction. The inner area 2*a* ranges from several millimeters to several centimeters depending upon the polishing conditions and the elastic modulus of the insert pad 3*c*. As a result, the semiconductor wafer WF3 is softly pressed against the inner area 2*a*, and the semiconductor wafer WF3 is partially less polished by the polishing pad 2.

If the deformation of the polishing pad 2 takes place outside of a semiconductor wafer, the deformation would not affect the polishing rate. From this aspect, the retainer ring 3*d* is replaced with a retainer ring 7*a* which is regulated in such a manner as to be held in contact with the polishing pad 2 together with the semiconductor wafer WF3. When the retainer ring 7*a* and the semiconductor wafer WF3 are pressed against the polishing pad 2, the contact pressure is maximized at the outer periphery of the retainer ring 7*a*, and the polishing pad 2 is deformed inside the outer periphery of the retainer ring 7*a* as shown in FIG. 5. However, the retainer ring 7*a* is designed to be wider than the inner area 2*a*, and the deformed area 2*b* is expected not to reach the outer periphery of the semiconductor wafer WF3.

However, the retainer ring 7*a* widely deforms the polishing pad 2, and the deformed area 2*b* reaches the outer peripheral area of the semiconductor wafer WF3 as shown in FIG. 5. Otherwise, the retainer ring 7*a* deforms the polishing pad 2 twice as shown in FIG. 6. Even if a non-deformed area 2*c* takes place between the outer deformed area 2*b*' and the inner deformed area 2*b*", the inner deformed area 2*b*" reduces the contact pressure between an inner area of the semiconductor wafer WF3 and the polishing pad 2.

The reason why the polishing pad 2 is widely deformed is that the sharp outer peripheral edge 7*b* of the retainer ring 7*a* exerts larger pressure on the polishing pad 2. If the retainer ring 7*a* is wider than the deformed area 2*b* and the total width of the outer deformed area 2*b*', the non-deformed area 2*c* and the inner deformed area 2*b*", the deformation would not affect the polishing rate. However, such an extremely wide retainer ring 7*a* impedes the mixture 5*a* toward the contact area between the semiconductor wafer WF3 and the polishing pad 2, and decreases the polishing rate.

Another problem is analogous to a dressing effect concurrently carried out together with a polishing. It has been known to a person skilled in the art that the dressing concurrently carried out together with the polishing makes the polishing rate stable; however, the dressing effect deteriorates the flatness as reported by Hayakawa and Muroyama in the proceedings of 42 Spring Meetings of Japanese Applied Physics, page 788, 30p-C-16. When the retainer ring 7*a* is held in contact with the polishing pad 2, the flatness is deteriorated. Moreover, while the retainer ring 7*a* is being rubbed with the polishing pad 2, undesirable contaminant is spread over the polishing pad 2, and is taken into the semiconductor wafer WF3. The contaminant thus taken into the semiconductor wafer WF3 deteriorates the device characteristics of integrated circuit devices fabricated on the semiconductor wafer WF3.

These are deteriorated with age, and, accordingly, affect the reproducibility. Another factor of the poor reproducibility relates to the insert pad 3*c*. The insert pad 3*c* is resiliently compressive, and allows the semiconductor wafer WF3 to sink depending upon the reaction of the load exerted on the semiconductor wafer WF3. Moreover, the insert pad 3*c* tends to lose the resiliency with time. For this reason, even if the wafer holder 3 exerts constant load on the semiconductor wafer WF3, the projecting length of the semiconductor wafer WF3 is changed, and, accordingly, varies the influence of the dressing effect and the feeding rate of the mixture 5*a* to the gap between the semiconductor wafer WF3 and the polishing pad 2.

Thus, the prior art polishing apparatus suffers from undesirable variation in the polishing rate and unstable uniformity on the polished surface.

SUMMARY OF THE INVENTION

It is therefore an important object of the present invention to provide a polishing apparatus which uniformly finishes a surface at a constant polishing rate without contamination from a retainer ring.

It is also an important object of the present invention to provide a method of regulating a retainer ring to an appropriate configuration for the polishing apparatus.

To accomplish the object, the present invention proposes to decrease the maximum contact pressure between a retainer ring and a polishing pad.

In accordance with one aspect of the present invention, there is provided a polishing apparatus for polishing a wafer comprising a polishing pad, a wafer holder provided over the polishing pad and including a hub member and a retainer ring attached to a lower surface of the hub member so as to define an inner space between the hub member and the polishing pad where the wafer is accommodated, and a driving means for generating a relative motion between the wafer and the polishing pad, and the retainer ring has an upper surface opposing the lower surface of the hub member, a lower surface pressed against the polishing pad together with the wafer, a side surface merged with the upper surface and a round surface merged with the side surface and the lower surface.

In accordance with another aspect of the present invention, there is provided a polishing apparatus for polishing a wafer comprising a polishing pad, a wafer holder provided over the polishing pad and including a hub member and a retainer ring attached to a lower surface of the hub member so as to define an inner space between the hub member and the polishing pad where the wafer is accommodated, and a driving means for generating a relative motion between the contact surface portion/the surface portion and the polishing pad, and the retainer ring has a contact surface portion formed of the same material as a surface portion of the wafer to be polished and held in contact with the polishing pad together with the surface portion of the wafer.

In accordance with yet another aspect of the present invention, there is provided a method of regulating a retainer ring to an appropriate configuration, comprising the steps of attaching a retainer ring having a contact surface portion formed of quartz to a rotatable hub member, retaining a dummy wafer with the retainer ring on a polishing pad, polishing the dummy wafer and the retainer ring through a relative motion to the polishing pad so as to transfer a deformation of the polishing pad to the contact surface portion of the dummy retainer ring, and determining a width of the dummy retainer ring in such a manner as to prevent a wafer from the deformation.

BRIEF DESCRIPTION OF THE DRAWINGS

The features and advantages of the polishing apparatus and the method according to the present invention will be more clearly understood from the following description taken in conjunction with the accompanying drawings in which.

DESCRIPTION OF THE PREFERRED EMBODIMENTS

First Embodiment

Figure 7:
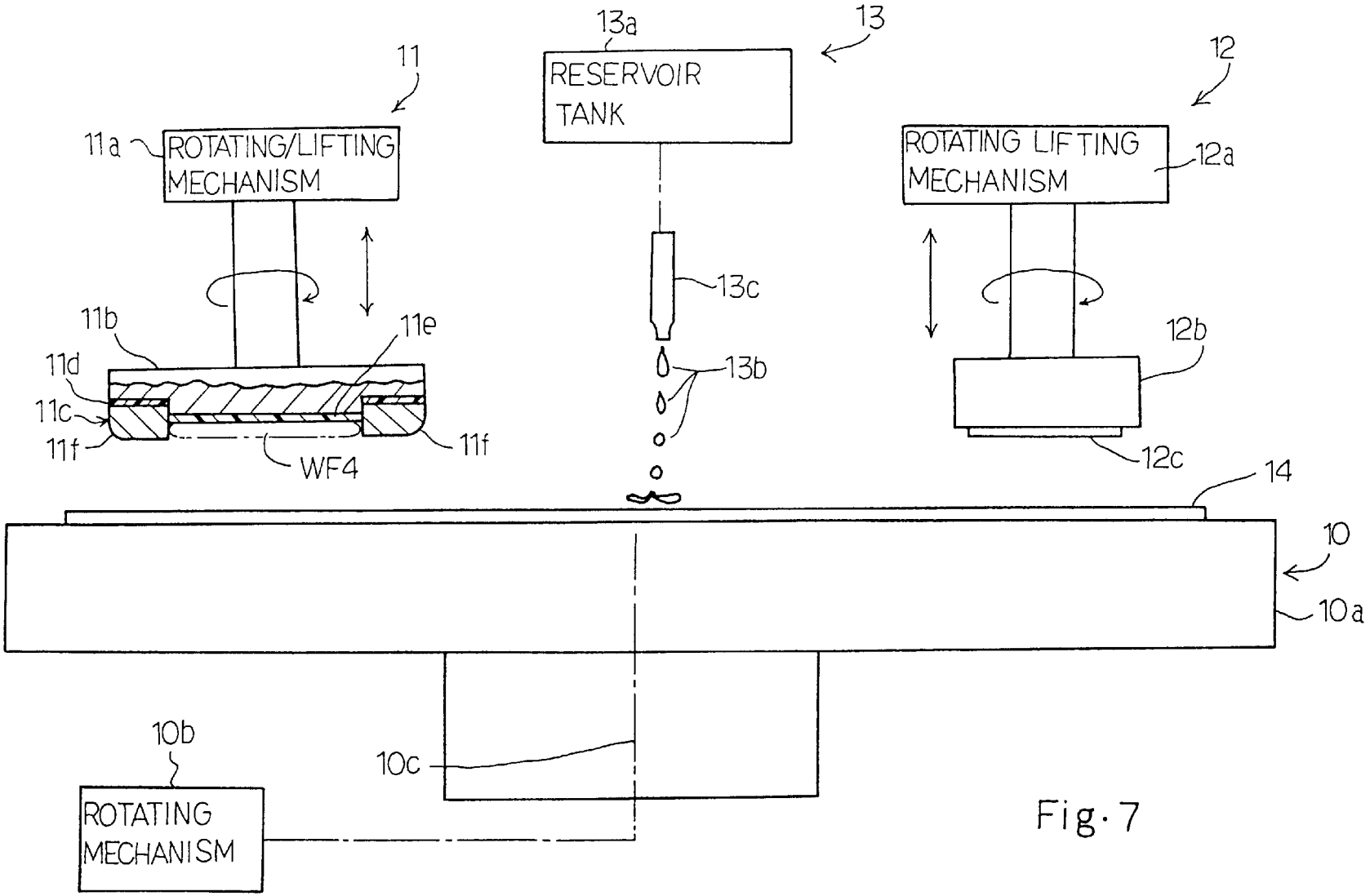
FIG. 7 is partially cut-away schematic view showing a polishing apparatus according to the present invention.

Referring to FIG. 7 of the drawings, a polishing apparatus embodying the present invention largely comprises a turn table structure 10, a wafer holder 11, a cleaner 12, a slurry feeder 13 and a polishing pad 14. Though not shown in FIG. 7, the turn table 10 is rotatably supported by a frame structure, and the frame structure maintains the wafer holder 11, the cleaner 12 and the slurry feeder 13 over the turn table 10.

The turn table 10 includes a disk-shaped table 10*a* rotatable with respect to the frame structure (not shown) and a driving mechanism 10*b* connected to the disk-shaped table 10*a*. When the driving mechanism 10*b* is energized, the driving mechanism 10*b* rotates the disk-shaped table 10*a* around the center axis 1-*c* thereof. The polishing pad 14 is placed on the upper surface of the disk-shaped table 10*a*, and is a two-layer lamination. A soft cushion layer and a hard polishing layer form in combination the polishing pad 14 as similar to that of the prior art polishing pad 2.

The wafer holder 11 includes a rotating/lifting mechanism 11*a*, a hub member 11*b* connected to the rotating/lifting mechanism 11*a*, a retainer ring 11*c* detachable from the hub member 11*b*, a cushion member 11*d* inserted between the hub member 11*b* and the retainer ring 11*c* and an insert pad 11*e*.

Figure 8:
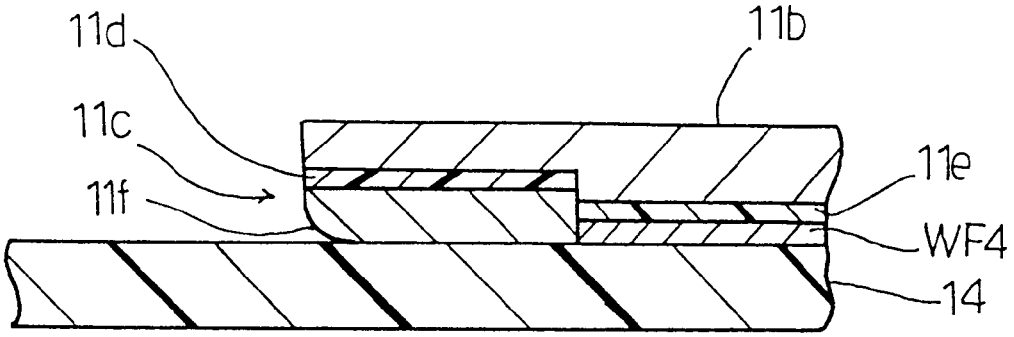
FIG. 8 is a cross sectional view showing a retainer ring and a semiconductor wafer pressed against a polishing pad.

The retainer ring 11*c* is formed of hard synthetic resin, and prevents a semiconductor wafer WF4 from a side slip on the polishing pad 14 during polishing. The semiconductor wafer WF4 may be covered with a silicon oxide layer to be polished. The outer periphery 11*f* of the retainer ring 11*c* is rounded, and the radius of curvature of the outer periphery 11*f* is 1 millimeter in this instance. The insert pad 11*e* has resiliency, and is sandwiched between the lower surface of the hub member 11*b* and the semiconductor wafer WF4. The cushion member 11*d* also has resiliency, and is inserted between the lower surface of the hub member 11*b* and the retainer ring 11*c*. In this instance, the cushion member 11*d* is formed of certain resilient material same as the insert pad 11*e*. The insert pad 11*e* and the cushion member 11*d* regulate the semiconductor wafer WF4 and the retainer ring 11*c* in such a manner as to be coplanar with each other on the polishing pad 14 as shown in FIG. 8. The cushion member 11*d* and the insert pad 11*e* as a whole constitute a regulating means.

The rotating/lifting mechanism 11*a* presses the retainer ring 11*f* and the semiconductor wafer WF4 against the polishing pad 14, and rotates them thereon so as to polish the semiconductor wafer WF4. When the retainer ring 11*c* is pressed against the polishing pad 14 together with the semiconductor wafer WF4, the retainer ring 11*c* is held in contact with the polishing pad 14 over 10 millimeter in width. The rotating mechanism 10*b* and the rotating/lifting mechanism 11*a* as a whole constitute a driving means for generating a relative motion between the semiconductor wafer WF4 and the polishing pad 14.

The conditioner 12 includes a rotating/lifting mechanism 12*a*, a hub member 12*b* connected to the rotating/lifting mechanism 12*a* and a diamond-coated pellet 12*c* retained by the hub member 12*b*. The rotating/lifting mechanism 12*a* gives rise to a relative motion between the polishing pad 14 and the diamond-coated pellet 12*c* between the polishing works, and keeps the polishing pad 14 clean.

The diamond-coated pellet 12*c* may be used for the polishing pad 14 during the polishing.

The slurry feeder 13 includes a reservoir tank 13*a* filled with mixture 13*b* of polishing slurry and water and a nozzle 13*c* connected to the reservoir tank 13*a*. While the polishing pad 14 is polishing the semiconductor wafer WF4, the mixture 13*b* is dripped onto the polishing pad 14 for a chemical and mechanical polishing.

The polishing is carried out as follows. First, the semiconductor wafer WF4 is regulated in such a manner as to be substantially coplanar with the lower surface of the retainer ring 11*c*. The rotating/lifting mechanism 11*a* presses the semiconductor wafer WF4 and the retainer ring 11*c* against the polishing pad 14, and the rotating mechanism 10*b* and the rotating/lifting mechanism 11*a* give rise to a relative motion between the polishing pad 14 and the semiconductor wafer/retainer ring WF4/11*c*.

The cushion member 11*d* and the insert pad 11*e* keep the semiconductor wafer WF4 and the retainer ring 11*c* substantially coplanar with each other on the polishing pad 14, i.e., the projection length of the semiconductor wafer WF4 from the lower surface of the retainer ring 11*c* is approximately equal to zero during the polishing. Even through the polishing conditions are changed, the cushion member 11*d* and the insert pad 11*e* keep the relation between the semiconductor wafer WF4 and the retainer ring 11*c*, i.e., the semiconductor wafer WF4 and the retainer ring 11*c* substantially coplanar with each other on the polishing pad 14. Although long running hours deteriorate the cushion member 11*d* and the insert pad 11*e* in resiliency, the aged deterioration evenly affects the cushion member 11*d* and the insert pad 11*e*, and the cushion member 11*d* and the insert pad 11*e* still keep the semiconductor wafer WF4 and the retainer ring 11*c* coplanar with each other on the polishing pad 14.

The round outer periphery 11*f* decreases the dressing effect to the polishing pad 14, and effectively achieves good surface flatness. Moreover, the round outer periphery 11*f* allows the mixture 13*b* to flow through the retainer ring 11*c* into the semiconductor wafer WF4, and the mixture 13*b* makes the polishing stable.

Figure 9:
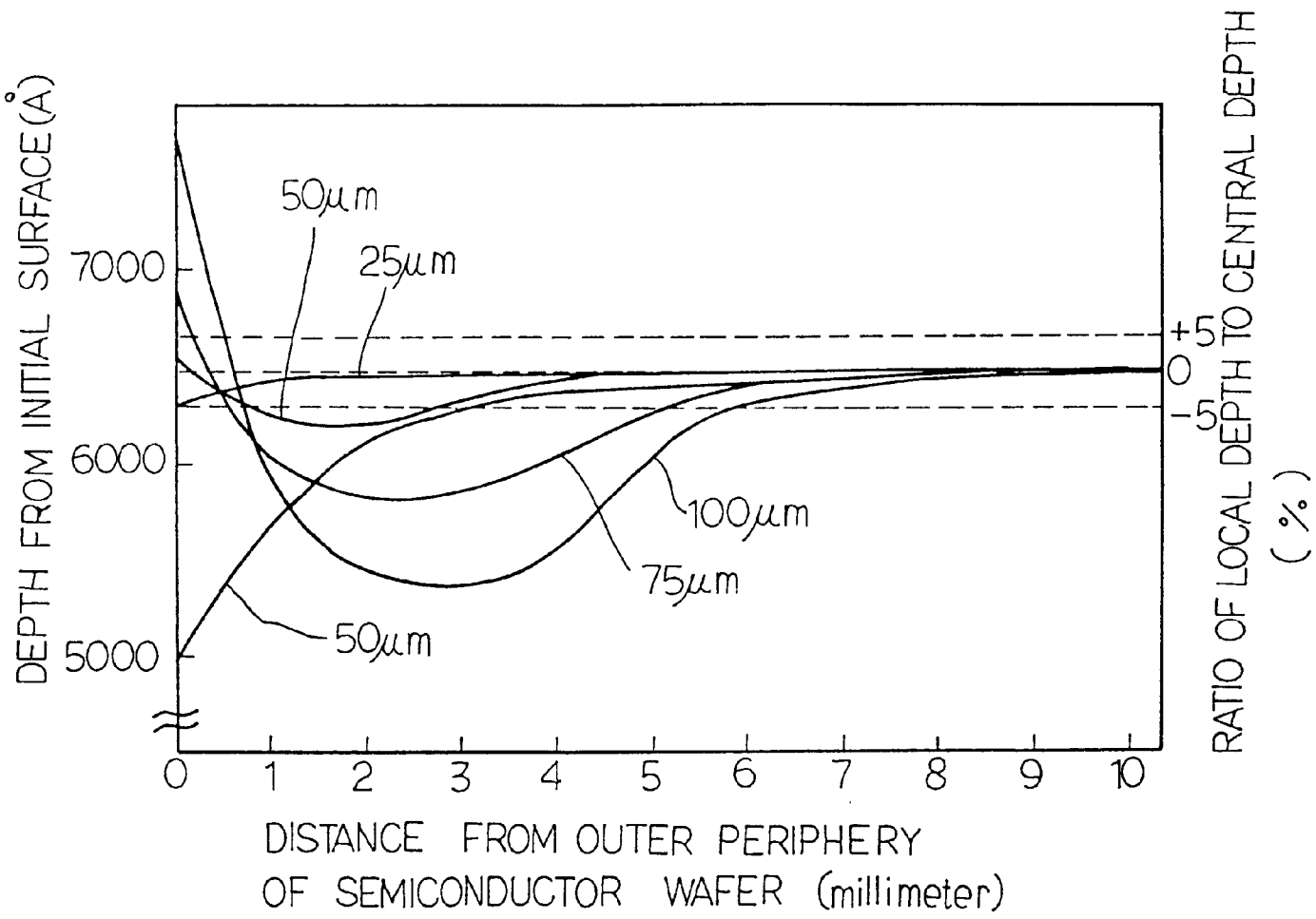
FIG. 9 is a graph showing the surface profile of polished semiconductor wafers.

The present inventors measured the surface profile of semiconductor wafers, and plotted in FIG. 9. The projection length of the semiconductor wafers from the retainer ring was changed from −50 microns through 25 microns, 50 microns, 75 microns to 100 microns. When the projection length was regulated within ±50 microns, the ratio of local depth to central depth at or inside of 3 millimeters from the outer periphery of the semiconductor wafers fell within ±5 percent. The "local depth" and the "central depth" respectively mean the depth at an arbitrary point from the initial surface and the depth in a central area from the initial surface.

The present inventors further evaluated influences of the round outer periphery 11*f* and the contact width between the retainer ring 11*c* and the polishing pad 14. The present inventors prepared various retainer rings 11*c* different in radius of curvature R of the round outer periphery 11*f* and the width W of the flat lower surface, i.e., the contact width between the retainer ring 11*c* and the polishing pad 14.

Using the retainer rings 11*c*, the present inventors polished the semiconductor wafers WF4, and, thereafter, measured the ratio of local depth to central depth DP, the polishing rate PL in the central area, the uniformity UF in the central area and the global step GS as shown in table 1.

Figure 1:
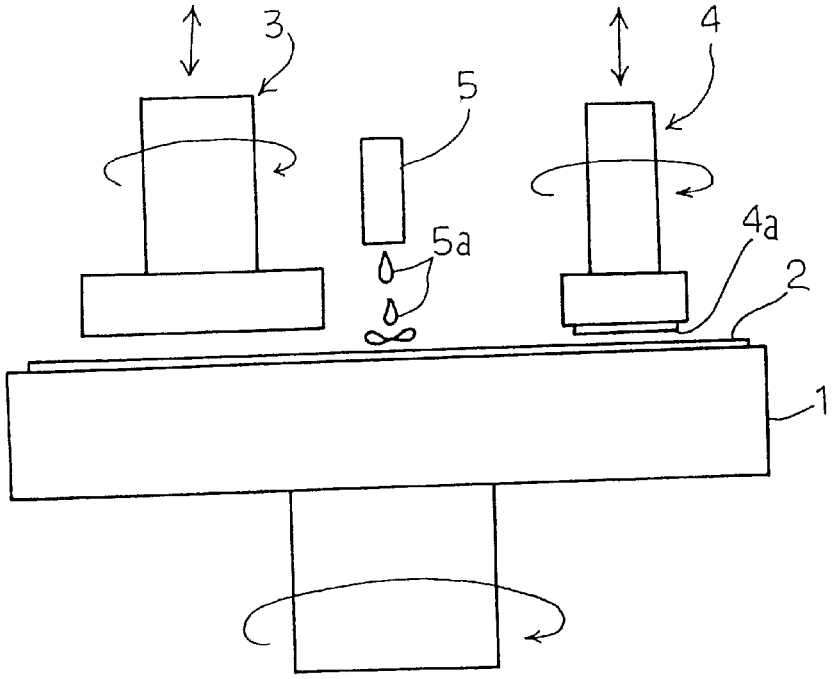
Fig·1 PRIOR ART
FIG. 1 is a schematic view showing the prior art polishing apparatus.
Figure 2:
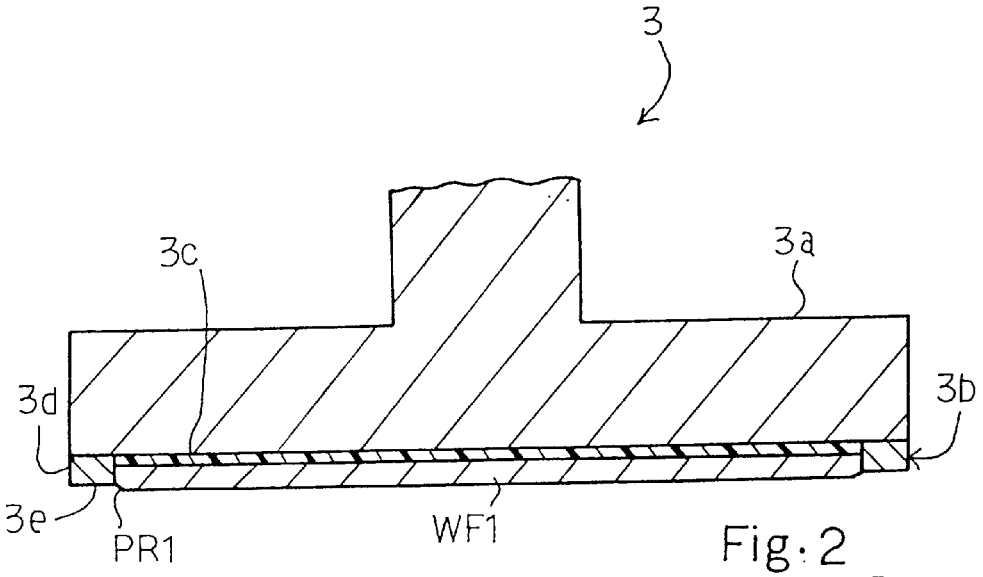
Fig·2 PRIOR ART
FIG. 2 is a cross sectional view showing the semiconductor wafer held by the wafer holder of the prior art polishing apparatus.
Figure 3A:
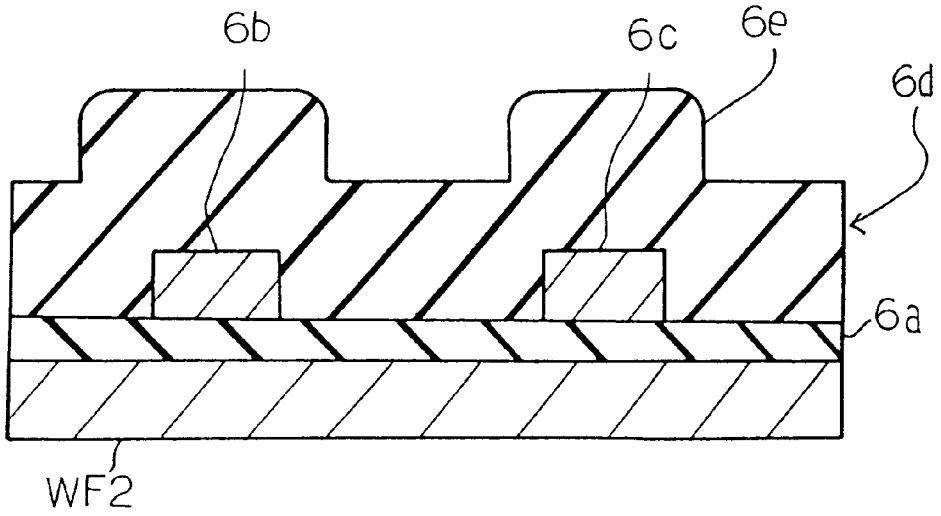
Fig. 3A PRIOR ART
FIGS. 3A and 3B are cross sectional views showing the polishing sequence carried out by using the prior art polishing apparatus.
Figure 3B:
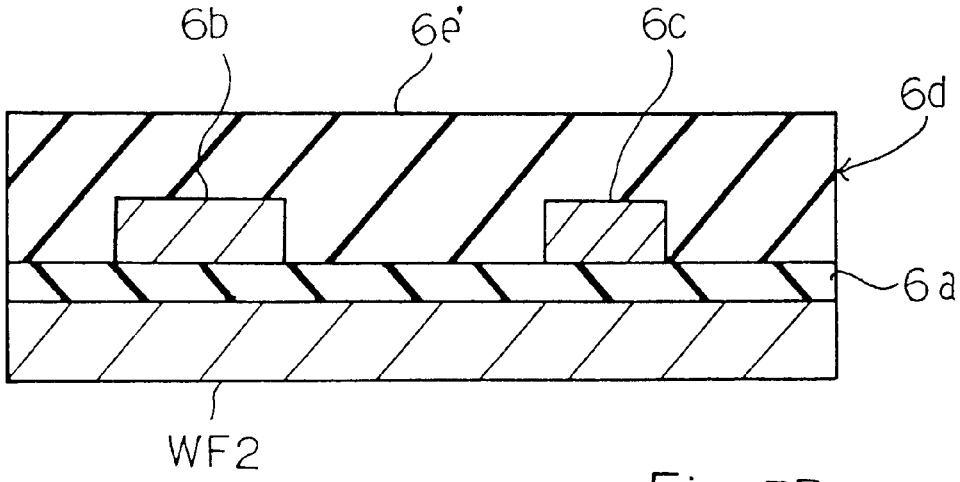
Fig. 3B PRIOR ART
Figure 4:
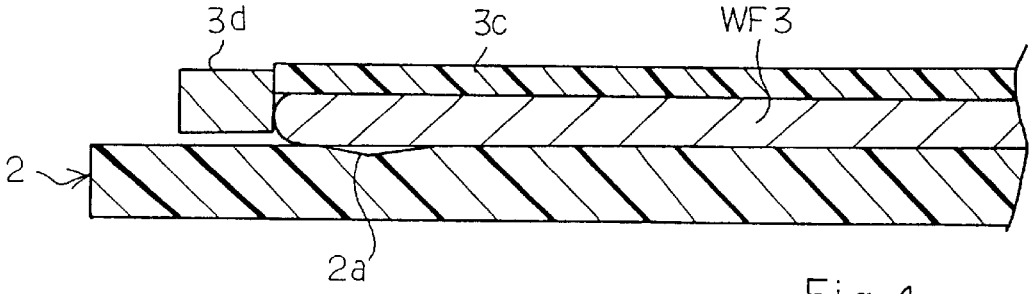
Fig. 4 PRIOR ART
FIG. 4 is a cross sectional view showing the deformation of the polishing pad due to the pressure of the semiconductor wafer.
Figure 5:
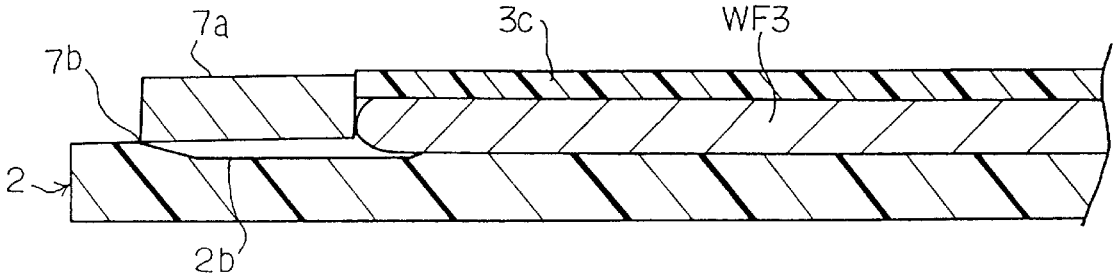
Fig. 5 PRIOR ART
FIG. 5 is a cross sectional view showing the deformation of the polishing pad due to the pressure of the wide retainer ring.
Figure 6:
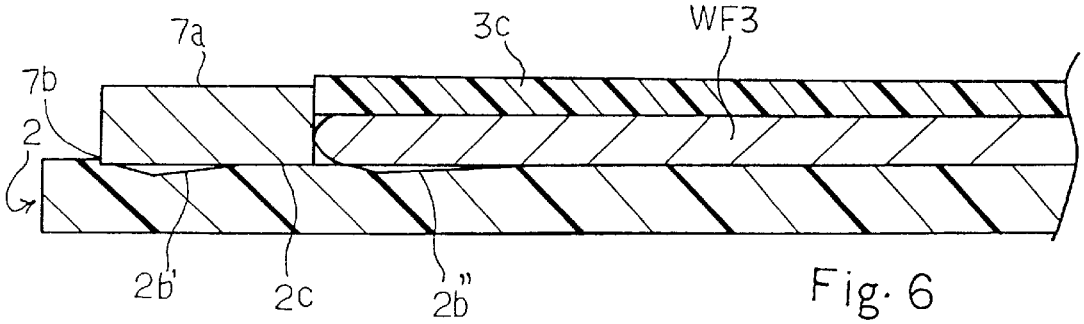
Fig. 6 PRIOR ART
FIG. 6 is a cross sectional view showing another kind of deformation of the polishing pad due to the pressure of the wide retainer ring.

The global step GS is described hereinbefore in connection with FIGS. 3A and 3B, and is a step produced in an inter-level insulating layer over a metal wiring of 0.8 micron thick between a portion over a patter of 3 mm×3 mm and a portion without a pattern. NW stands for a width of a non-effective area on the semiconductor wafers WF4, and the non-effective area is less in ratio of local depth to central depth than −5 percent and greater than +5 percent. PR represents the projection length of the semiconductor wafer WF4 from the retainer 11*c*.

TABLE 1

| R (mm) | W (mm) | NW (mm) | PL (angstrom/min) | UF (%) | GS (angstrom) | PR (micron) |
|---|---|---|---|---|---|---|
| 0 | 10 | 6 | 1300 | 5 | 1000 | 200 |
| | 2 | 8 | 1300 | 5 | 1500 | 0 |
| | 4 | 8 | 1300 | 5 | 1500 | " |
| | 6 | 7 | 1300 | 5 | 1500 | " |
| | 8 | 6 | 1300 | 5 | 1500 | " |
| | 10 | 5 | 1250 | 7 | 1500 | " |
| | 15 | 4 | 1150 | 9 | 1500 | " |
| | 20 | 3 | 1000 | 12 | 1500 | " |
| 0.75 | 2 | 6 | 1300 | 5 | 1300 | " |
| | 4 | 6 | 1300 | 5 | 1300 | " |
| | 6 | 5 | 1300 | 5 | 1300 | " |
| | 8 | 5 | 1300 | 5 | 1300 | " |
| | 10 | 4 | 1300 | 5 | 1300 | " |
| | 15 | 3 | 1200 | 7 | 1300 | " |
| | 20 | 2 | 1100 | 10 | 1300 | " |
| 1.0 | 2 | 5 | 1300 | 5 | 1150 | " |
| | 4 | 5 | 1300 | 5 | 1150 | " |
| | 6 | 4 | 1300 | 5 | 1150 | " |
| | 8 | 4 | 1300 | 5 | 1150 | " |

TABLE 1-continued

| R (mm) | W (mm) | NW (mm) | PL (angstrom/min) | UF (%) | GS (angstrom) | PR (micron) |
|---|---|---|---|---|---|---|
| | 10 | 3 | 1300 | 5 | 1150 | " |
| | 15 | 2 | 1250 | 6 | 1150 | " |
| | 20 | 1 | 1200 | 7 | 1150 | " |
| 1.25 | 2 | 5 | 1300 | 5 | 1150 | " |
| | 4 | 5 | 1300 | 5 | 1150 | " |
| | 6 | 4 | 1300 | 5 | 1150 | " |
| | 8 | 3 | 1300 | 5 | 1150 | " |
| | 10 | 2 | 1300 | 5 | 1150 | " |
| | 15 | 1 | 1250 | 6 | 1150 | " |
| | 20 | 1 | 1200 | 7 | 1150 | " |
| 1.5 | 2 | 5 | 1300 | 5 | 1150 | " |
| | 4 | 5 | 1300 | 5 | 1150 | " |
| | 6 | 4 | 1300 | 5 | 1150 | " |
| | 8 | 3 | 1300 | 5 | 1150 | " |
| | 10 | 2 | 1300 | 5 | 1150 | " |
| | 15 | 1 | 1250 | 6 | 1150 | " |
| | 20 | 1 | 1200 | 7 | 1150 | " |

As will be understood from the foregoing description, the width of the non-effective area NW and the polishing rate PL where inversely proportional to the width of retainer ring W, and the uniformity UF was deteriorated together with the polishing rate PL due to a large impedance of the retainer ring 11*c* against the flow of mixture 13*b*. A large radius of curvature R was desirable, because the large radius of curvature R prevented the semiconductor wafers WF4 from a wide non-effective area NW in spite of a narrow width W of the retainer ring 11*c*. Especially, when the radius of curvature R was equal to or greater than 1 millimeter, the retainer ring 11*c* was effective against non-acceptable surface profile of the semiconductor wafer. The retainer ring 11*c* slightly degraded the global step GS.

As will be appreciated from the foregoing description, the polishing apparatus according to the present invention is equipped with a retainer ring having a round outer periphery, and the round outer periphery is effective against a local slope on the polished surface of the semiconductor wafer WF4.

Second Embodiment

Figure 10:
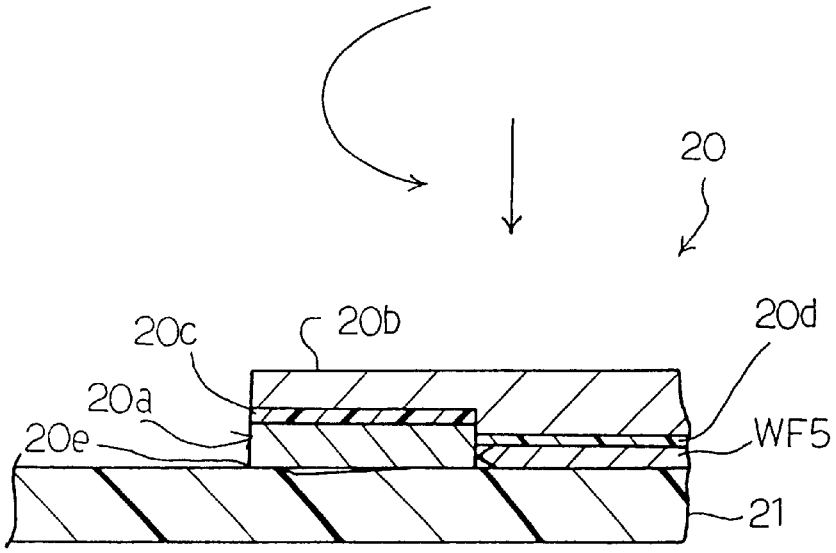
FIG. 10 is a cross sectional view showing a wafer holder incorporated in another polishing apparatus according to the present invention.

Turning to FIG. 10 of the drawings, another wafer holder 20 retains a semiconductor wafer WF5 covered with a silicon oxide layer to be polished on a polishing pad 21. The wafer holder 20 forms a part of a polishing apparatus embodying the present invention, and other component members and units are similar to those of the first embodiment. For this reason, description is focused on the wafer holder 20.

The wafer holder 20 includes a retainer ring 20*a* and a hub member 20*b* having a central lower surface and an peripheral lower surface. The retainer ring 20*a* is attached to the hub member 20*b*, and a cushion member 20*c* is inserted between the lower peripheral surface and the retainer ring 20*a*. An insert pad 20*d* is provided between the lower central surface of the hub member 20*b* and the semiconductor wafer WF5, and the hub member 20*b* presses the retainer ring 20*a* and the semiconductor wafer WF5 against the polishing pad 21. The cushion member 20*c* and the insert pad 20*d* are formed of certain resilient material, and regulates the retainer ring 20*a* and the semiconductor wafer WF5 in such a manner as to be substantially coplanar with each other on the polishing pad 21. The cushion member 20*c* and the insert pad 20*d* thus formed of the same material is effective against aged deterioration, because the aged deterioration evenly degrades the resiliency of the cushion member 20*c* and the insert pad 20*d*. The cushion member 20*c* and the insert pad 20*d* as a whole constitute a regulating means.

If the difference between the lower surface of the retainer ring 20*a* and the polished surface of the semiconductor wafer WF5 is equal to or less than 50 microns, the polishing apparatus achieves a good surface flatness as similar to the first embodiment.

The retainer ring 20*a* is formed of quartz or has a lower surface portion of quartz, and the outer periphery 20*e* is equal in radius of curvature to or less than 0.1 millimeter. The retainer ring 20*a* is held in contact with the polishing pad 21 through the quartz, and is free from the dressing effect. Moreover, the surface portion of the semiconductor wafer WF5 to be polished is the same material as the retainer ring 20*a*, and, for this reason, the semiconductor wafer WF5 is free from contamination from the retainer ring 20*a*. The quartz may be deposited by using a chemical vapor deposition.

The present inventors evaluated the polishing apparatus implementing the second embodiment as similar to the first embodiment. The evaluation was summarized in table 2.

TABLE 2

| R (mm) | W (mm) | NW (mm) | PL (angstrom/min) | UF (%) | GS (angstrom) |
|---|---|---|---|---|---|
| 0 | 10 | 6 | 1300 | 5 | 1000 |

As will be understood, the non-effective area on the semiconductor wafer WF5 was narrow, and the present inventors confirmed that the quartz was effective against the local slope.

If the radius of curvature of the outer periphery 20*e* is enlarged to be at least 1 millimeter, the surface profile, the polishing rate and the uniformity are drastically improved.

Subsequently, description is made on a method of regulating the quartz retainer ring 20*a* to an appropriate configuration. First, the retainer ring 20*a* is attached to the hub member 20*b*, and a dummy wafer is retained on the polishing pad 21 as similar to the semiconductor wafer WF5. The dummy wafer is polished through a relative motion between the polishing pad 21 and the dummy wafer for 100 minutes, and the retainer ring 20*a* is also polished on the polishing pad 21.

Upon expiry of the polishing time, the contact surface 20*f* of the retainer ring 20*a* is shaped along the deformed surface of the polishing pad 21.

Figure 11:
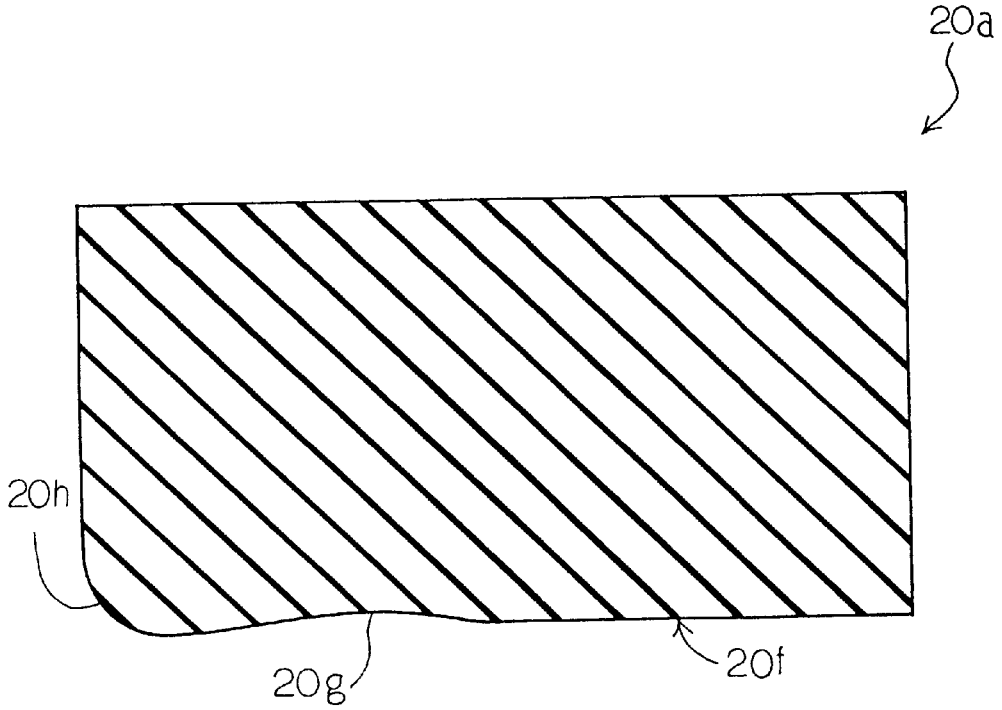
FIG. 11 is a cross sectional view showing the configuration of a quartz retainer ring subjected to a polishing.

However, the retainer ring 20*a* may be released from the hub member 20*b* upon extiry of the polishing time so as to observe the contact surface 20*f*. While the retainer ring 20*a* is being polished together with the dummy wafer, the deformed surface of the polishing pad 21 is transferred to the contact surface 20*f*; a local slope 20*g* takes place in the contact surface 20*g*, and the outer periphery 20*h* is rounded as shown in FIG. 11. Then, an analyst can determined where the deformation takes place in the polishing pad 21 on the basis of the local slope 20*g* and how the deformation affects the outer periphery of the retainer ring 20*a*. If the retainer ring 20*a* is wide enough to prevent a semiconductor wafer from the deformation corresponding to the local slope 20*g* and the outer periphery 20*h* is previously rounded, the polishing apparatus achieves a good surface profile on the semiconductor wafer. Thus, the analyst regulates the retainer ring 20*a* to an appropriate configuration having the minimum width for preventing a semiconductor wafer from the deformation and previously rounded outer periphery 20*h*.

A quartz retainer ring was used for polishing a dummy wafer for 100 minutes, and the contact surface of the quartz retainer rings was automatically matched with the deformed surface of the polishing pad. Using the quartz retainer ring thus automatically matched with the deformed surface of the polishing pad, even though the contact width between the quartz retainer ring and the polishing pad was minimized, an abnormal profile did not take place in the semiconductor wafer after a polishing. The polishing data were summarized in Table 3.

TABLE 3

| R (mm) | W (mm) | NW (mm) | PL (angstrom/min) | UF (%) | GS (angstrom) |
|---|---|---|---|---|---|
| 1 | 10 | 2 | 1300 | 5 | 1000 |

As will be understood from table 3, the width of non-effective area NW is drastically decreased rather than the semiconductor wafer shown in table 2, and the method of regulating the retainer ring effectively improves the surface profile of the semiconductor wafer.

Third Embodiment

Figure 12:
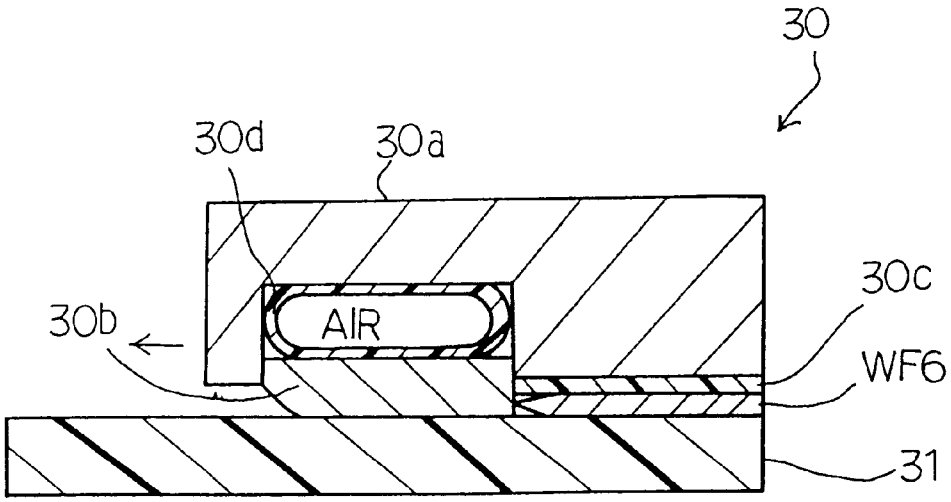
FIG. 12 is a cross sectional view showing a wafer holder incorporated in yet another polishing apparatus according to the present invention.

Turning to FIG. 12 of the drawings, a wafer holder incorporated in a polishing apparatus embodying the present invention includes a hub member 30*a*, a retainer ring 30*b*, a resilient insert pad 30*c* provided between the hub member 30*a* and a semiconductor wafer WF6 and an air bag 30*d* inserted between the hub member 30*a* and the retainer ring 30*b*. In this instance, the insert pad 30*c* and the air bag 30*d* form in combination a regulating means.

The wafer holder 30 forms a part of a polishing apparatus embodying the present invention, and the other component members and units are similar to those of the first embodiment. For this reason, no further description is made on the other component members and units.

The inside air pressure of the air bag 30*d* is regulable, and the insert pad 30*c* and the air bag 30*d* regulates the retainer ring 30*b* and the semiconductor wafer WF6 to be coplanar with each other on a polishing pad 31. The difference between the lower surface of the retainer ring 30*b* and the lower surface of the semiconductor wafer WF6 is equal to or less than 50 microns on the polishing pad 31.

The polishing apparatus implementing the third embodiment achieves all the advantages of the first embodiment.

Fourth Embodiment

Figure 13:
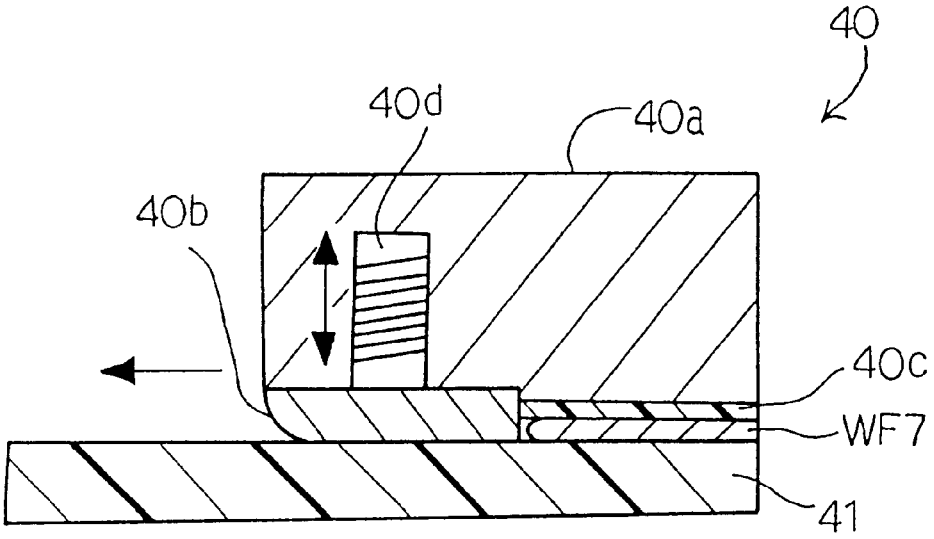
FIG. 13 is a cross sectional view showing a wafer holder incorporated in still another polishing apparatus according to the present invention.

Turning to FIG. 13 of the drawings, a wafer holder 40 incorporated in a polishing apparatus embodying the present invention includes a hub member 40*a*, a retainer ring 40*b*, a resilient insert pad 40*c* provided between the hub member 40*a* and a semiconductor wafer WF7 and a regulator 40*d* inserted between the hub member 40*a* and the retainer ring 40*b*. In this instance, the insert pad 40*c* and the regulator 40*d* form in combination a regulating means.

The wafer holder 40 forms a part of a polishing apparatus embodying the present invention, and the other component members and units are similar to those of the first embodiment. For this reason, no further description is made on the other component members and units.

The regulator 40*d* memorizes the aged deterioration of the insert pad 40*c*, and changes the force exerted on the retainer ring 40*b* in such a manner as to regulate the retainer ring 40*b* and the semiconductor wafer WF7 to be coplanar with each other on a polishing pad 41. The difference between the lower surface of the retainer ring 40*b* and the lower surface of the semiconductor wafer WF7 is equal to or less than 50 microns on the polishing pad 31.

The polishing apparatus implementing the fourth embodiment achieves all the advantages of the first embodiment.

Although particular embodiments of the present invention have been shown and described, it will be obvious to those skilled in the art that various changes and modifications may be made without departing from the spirit and scope of the present invention.

What is claimed is:

1. A polishing apparatus for polishing a wafer, comprising:

a polishing pad;

a wafer holder provided over said polishing pad, and including a hub member and a retainer ring attached to a lower surface of said hub member so as to define an inner space between said hub member and said polishing pad where said wafer is accommodated, said retainer ring having an upper surface opposing said lower surface of said hub member, a lower surface pressed against said polishing pad together with said wafer, a side surface merged with said upper surface and a round surface merged with said side surface and said lower surface; and a driving means for generating a relative motion between said wafer and said polishing pad.

2. The polishing apparatus as set forth in claim 1, further comprising a regulating means resiliently inserted between said hub member and said retainer ring and between said hub member and said wafer for maintaining said lower surface of said retainer ring and a polished surface of said wafer approximately coplanar on said polishing pad.

3. The polishing apparatus as set forth in claim 1, in which said round surface has a radius of curvature equal to or greater than 1 millimeter.

4. The polishing apparatus of claim 2, wherein said regulating means maintains a first plane defined by said lower surface of said retainer ring within 50 microns of a second plane defined by said polished surface.

5. The polishing apparatus of claim 2, wherein said regulating means comprises an insert pad positioned intermediate said hub member and said wafer, and a cushion member positioned intermediate said hub member and said retainer ring.

6. The polishing apparatus of claim 5, wherein said insert pad and said cushion member are comprised of the same resilient material.

7. The polishing apparatus of claim 5, wherein said insert pad and said cushion member are designed to maintain approximately equal resiliency with deterioration over time.

8. The polishing apparatus of claim 5, wherein said cushion member comprises an air bag.

9. The polishing apparatus of claim 8, wherein an air pressure of said air bag may be regulated.

10. The polishing apparatus as set forth in claim 1, in which said lower surface of said retainer ring is formed of quartz.

11. A polishing apparatus for polishing a wafer, comprising:

a polishing pad;

a wafer holder provided over said polishing pad, and including a hub member and a retainer ring attached to a lower surface of said hub member so as to define an inner space between said hub member and said polishing pad where said wafer is accommodated, said retainer ring having a contact surface portion in contact with said polishing pad, an outer side surface, and a rounded outer periphery merging with said contact surface portion and said side surface; said rounded outer periphery having a radius of curvature not less than 1 millimeter; and a driving means for generating a relative motion between said contact surface portion/said surface portion and said polishing pad.

12. The polishing apparatus as set forth in claim 11, in which a contact surface portion of said retainer ring is formed of quartz.

13. The polishing apparatus as set forth in claim 12, further comprising a regulating means resiliently inserted between said hub member and said retainer ring and between said hub member and said wafer.

14. The polishing apparatus as set forth in claim 13, in which said retainer ring has an upper surface held in contact with said regulating means, said side surface merged with said upper surface.

15. The polishing apparatus as set forth in claim 13, wherein said contact surface of said retainer ring and a contact surface of a surface portion to be polished of said wafer are maintained approximately coplanar on said polishing pad.

16. The polishing apparatus of claim 15, wherein a first plane of said contact surface of said retainer ring and a second plane of said contact surface of said wafer are separated by no more than 50 microns.

* * * * *